US008875883B2

(12) United States Patent
Kinskey et al.

(10) Patent No.: US 8,875,883 B2
(45) Date of Patent: Nov. 4, 2014

(54) TIERED TOOL HOLDER

(71) Applicant: LF Centennial Ltd., Tortola (VG)

(72) Inventors: Terrence P. Kinskey, Alpharetta, GA (US); Matthew G. Williams, Lighthouse Point, FL (US)

(73) Assignee: LF Centennial Ltd., Tortola (VG)

( * ) Notice: Subject to any disclaimer, the term of this patent is extended or adjusted under 35 U.S.C. 154(b) by 0 days.

(21) Appl. No.: 13/800,394

(22) Filed: Mar. 13, 2013

(65) Prior Publication Data

US 2013/0199952 A1 Aug. 8, 2013

Related U.S. Application Data

(63) Continuation-in-part of application No. 13/543,314, filed on Jul. 8, 2012.

(60) Provisional application No. 61/505,697, filed on Jul. 8, 2011.

(51) Int. Cl.

| | |
|---|---|
| ***B65D 85/20*** | (2006.01) |
| ***B25H 3/00*** | (2006.01) |
| ***B65D 33/00*** | (2006.01) |
| ***B25H 3/02*** | (2006.01) |

(52) U.S. Cl.

CPC *B25H 3/00* (2013.01); *B65D 33/00* (2013.01); *B25H 3/021* (2013.01)

USPC ..... 206/373; 383/39

(58) Field of Classification Search

USPC ..... 206/372, 373; 383/39, 40; 220/23.83

See application file for complete search history.

(56) References Cited

U.S. PATENT DOCUMENTS

| | | | | |
|---|---|---|---|---|
| 3,717,188 | A * | 2/1973 | Green | 224/42.11 |
| 3,749,233 | A * | 7/1973 | McCormick, Jr. | 206/373 |
| 4,773,535 | A * | 9/1988 | Cook | 206/373 |
| 4,901,899 | A * | 2/1990 | Barrett | 224/223 |
| 4,953,765 | A * | 9/1990 | Little et al. | 224/583 |
| 4,993,551 | A | 2/1991 | Lindsay | |
| 5,174,447 | A * | 12/1992 | Fleming | 206/373 |
| 5,337,907 | A * | 8/1994 | McKenzie et al. | 211/88.01 |
| 5,427,239 | A * | 6/1995 | Hunt | 206/372 |
| D383,302 | S | 9/1997 | Broussard | |
| D396,912 | S | 8/1998 | Maire et al. | |
| D417,079 | S | 11/1999 | Heltzel | |
| 6,209,734 | B1 | 4/2001 | Wang | |
| 6,315,310 | B1 * | 11/2001 | Hurt | 280/79.5 |
| 6,536,590 | B1 * | 3/2003 | Godshaw et al. | 206/373 |

(Continued)

*Primary Examiner* — Jacob K Ackun

(74) *Attorney, Agent, or Firm* — Duane Morris LLP; J. Rodman Steele, Jr.; Gregory M. Lefkowitz

(57) ABSTRACT

A tool holder is described. The tool holder can include a main panel and a plurality of sleeves extending from a front side of the main panel. The plurality of sleeves can include a first sleeve component forming peaks and valleys, a second sleeve component coupled to the first sleeve component, and a third sleeve component forming a plurality of outer peaks and outer valleys coupled to the second sleeve component. At least one primary opening can be formed between the main panel and the first sleeve component between adjacent valleys. At least one secondary opening can be formed between the second sleeve component and the first sleeve component between adjacent peaks. At least one tertiary opening can be formed between the second sleeve component and the third sleeve component between adjacent outer valleys. A tool can be received through each opening and stored in the tool holder.

14 Claims, 12 Drawing Sheets

(56) References Cited

U.S. PATENT DOCUMENTS

| | | | | |
|---|---|---|---|---|
| D474,022 | S | 5/2003 | Leighton | |
| 6,571,998 | B2 | 6/2003 | Godshaw et al. | |
| 6,907,989 | B2 * | 6/2005 | Ho | 206/373 |
| D530,917 | S | 10/2006 | Conforti | |
| 7,311,200 | B2 | 12/2007 | Godshaw et al. | |
| D564,219 | S | 3/2008 | Bagus | |
| D613,507 | S | 4/2010 | Brouard | |
| D635,769 | S | 4/2011 | Sosnovsky | |
| 7,950,509 | B2 | 5/2011 | Redzisz | |
| 8,267,130 | B1 * | 9/2012 | Sinnett | 150/112 |
| 2005/0189388 | A1 * | 9/2005 | Godshaw et al. | 224/607 |
| 2006/0006619 | A1 | 1/2006 | Guirlinger | |
| 2006/0207902 | A1 | 9/2006 | Frye et al. | |
| 2009/0301912 | A1 | 12/2009 | Cornell | |
| 2011/0147428 | A1 * | 6/2011 | Crawford et al. | 224/584 |
| 2012/0247994 | A1 | 10/2012 | Moreau et al. | |

* cited by examiner

TIERED TOOL HOLDER

CROSS-REFERENCE TO RELATED APPLICATIONS

This application is a continuation-in-part of U.S. application Ser. No. 13/543,314 filed Jul. 6, 2012, entitled "TOOL HOLDER," which claims priority to U.S. Provisional Application No. 61/505,697, filed Jul. 8, 2011, the entireties of which are incorporated herein by reference.

FIELD OF THE INVENTION

The present invention relates generally to the field of tools and, more particularly, to holders for tools.

BACKGROUND

Tool holders are known to be useful for workers needing to organize, store or carry a group of tools or transport tools to and from a work site for a specific job. In conventional tool holders and tool bags, tools may be scattered haphazardly in a compartment or an initial placement of the tools will be scattered during transport, so that it may be difficult to quickly locate a specific tool when needed. While conventional tool holders and others of the prior art are useful in some instances, there are still numerous deficiencies and the potential for more useful tool holders and tool holder features.

SUMMARY

A tool holder according to the invention includes a main panel having a front side and a plurality of sleeves extending from the front side and forming openings, such that a tool can be received through each opening. The plurality of sleeves can include a first sleeve component forming a plurality of peaks and valleys, a second sleeve component coupled to the first sleeve component, and a third sleeve component coup led to the first sleeve component, the second sleeve component, or both. The third sleeve component can form a plurality of outer peaks and outer valleys.

At least one primary opening can be formed between the main panel and the first sleeve component between adjacent valleys. At least one secondary opening can be formed between the second sleeve component and the first sleeve component between adjacent peaks. At least one tertiary opening can be formed between the second sleeve component and the third sleeve component between adjacent outer valleys of the third sleeve component. A longitudinal axis of at least one tertiary opening can be substantially aligned with a longitudinal axis of at least one primary opening, a longitudinal axis of at least one secondary opening, or both. The longitudinal axes of at least one primary opening, secondary opening and/or tertiary opening can be substantially vertical. At least one tertiary opening can also be offset from at least one primary opening, at least one secondary opening, or both.

As used herein, the term "substantially" is intended to include minor deviations from the orientation, shape or size defined herein. For example, deviations of plus or minus 20 degrees, or plus or minus 15 degrees, or plus or minus 10 degrees, or plus or minus 5 decrees.

The valleys of the first sleeve component can be coupled to the front side of the main panel at a plurality of base coupling points. The second sleeve component can be coupled to the first sleeve component at a plurality of inner coupling points. The inner coupling points of the tool holder can be positioned at or between adjacent peaks of the first sleeve component.

The inner coupling points can also be positioned at the peaks of the first sleeve component. The inner coupling points can also include at least two points between adjacent peaks of the first sleeve component. The third sleeve component can be coupled to the first sleeve component, the second sleeve component, or both at a plurality of outer coupling points. The outer coupling points an also be vertically aligned with or between adjacent inner coupling points. The outer coupling points can also include at least two adjacent outer coupling points positioned between at least two adjacent inner coupling points.

The tool holder can also include a pocket extending from a lower end of the front side of the main panel. The pocket can include an inner cavity for receiving a tool supported by the plurality of sleeves. The pocket and the plurality of sleeves can be separated vertically by a distance adapted for receiving and storing a tool.

The plurality of sleeves of the tool holder can include materials selected from the group consisting of fabric, nonwovens, plastic, plastic-reinforced fabric, and combinations thereof. An upper edge of the first sleeve component can extend above an upper edge of the second sleeve component, can be flush with an upper edge of the second sleeve component, or can be below an upper edge of the second sleeve component. An upper edge of the third sleeve component can be below an upper edge of the second sleeve component, can be flush with an upper edge of the second sleeve component, or can extend above an upper edge of the second sleeve component.

In another embodiment, a tool bag having a tool bag body is described. The tool bag body can include an open topped storage volume formed from a bottom panel and a plurality of side panels. Each of the plurality of side panels can include a front side. The front side of the plurality of side panels can include an inner side of the plurality of side panels and/or an outer side of the plurality of side panels. At least one of the plurality of side panels can include a plurality of sleeves extending from the front side and forming openings, such that a tool can be received through each opening.

The plurality of sleeves can include a first sleeve component forming a plurality of peaks and valleys; a second sleeve component coupled to the first sleeve component; and a third sleeve component coupled to the first sleeve component, the second sleeve component, or both. The third sleeve component can form a plurality of outer peaks and outer valleys. At least one primary opening can be formed between the main panel and the first sleeve component between adjacent valleys of the first sleeve component; at least one secondary opening can be formed between the second sleeve component and the first sleeve component between adjacent peaks of the first sleeve component; and at least one tertiary opening can be formed between the second sleeve component and the third sleeve component between adjacent outer valleys of the third sleeve component. The bottom panel and the plurality of sleeves can be separated vertically by a distance adapted for receiving and storing a tool.

The tool bag can also include a pocket extending from a lower end of the front side of the side panel. The pocket can include an inner cavity for receiving a tool. The pocket and the plurality of sleeves can be separated vertically by a distance adapted for receiving and storing a tool. At least a portion of the pocket can also be formed by at least a portion of the bottom wall. The tool bag can also include a lid panel attached to the tool bag body.

These and other features, objects and advantages of the present invention will become more apparent to one skilled in the art from the following description and claims when read in light of the accompanying drawings.

DETAILED DESCRIPTION

Figure 1:
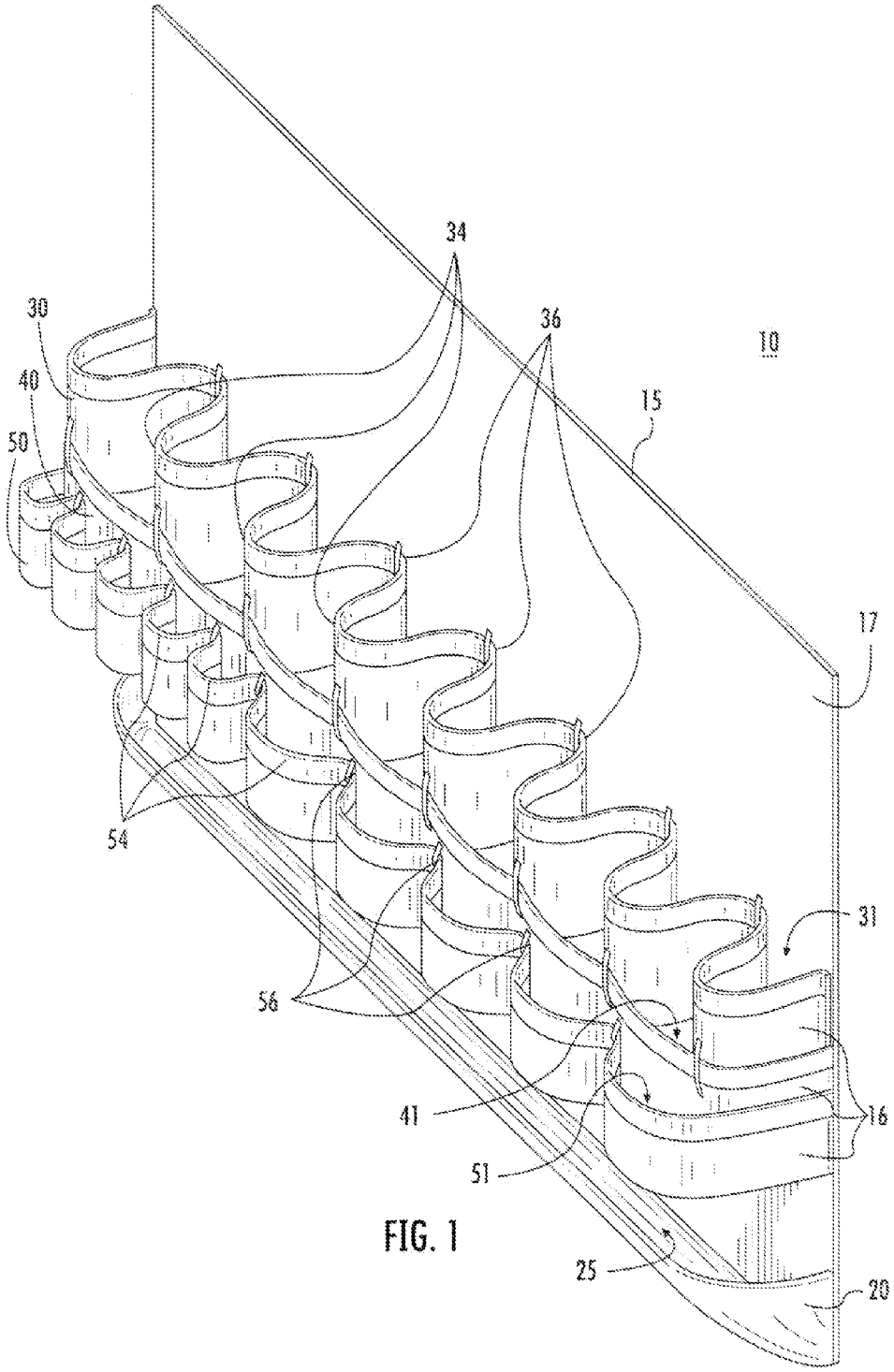
FIG. 1 is a perspective view of a tool holder described herein.

The description herein is directed to a tool holder, which can facilitate a worker's efficiency and organization on a project. The tool holder is configured to hold a variety of tools for easy storage, organization, transport and/or access when working on a project. Aspects of the invention will be explained in connection with a tool holder adapted for use with screwdrivers, but the detailed description is intended only as one example. The tool holder can be adapted for use with a variety of other tools such as wrenches, pliers, other hand tools, power tools, and power tool accessories (e.g., such as drill bits). Embodiments of the tool holder are shown in FIGS. 1-12, but the present invention is not limited to the illustrated structures or applications.

As shown in the Figures, a tool holder 10 with a main panel 15 and a plurality of sleeves 18 is described. The main panel 15 can be formed of flexible or rigid material. As used herein, the term "rigid" means capable of maintaining substantially the same shape, e.g. substantially planar, when the tool holder 10 is upright and/or when placed under loads typical of tool holders in use, e.g., 5 pounds, 10 pounds, 15 pounds, etc.

The main panel 15 can include a front side 17, and the plurality of sleeves 16 can extend from the front side 17 of the main panel 15. The sleeves 16 can be formed from first, second and third sleeve components 30, 40, 50. The sleeve components 30, 40, 50 can form primary, secondary and tertiary openings 31, 41, 51 such that a tool can be received through each opening 31, 41, 51.

Figure 3:
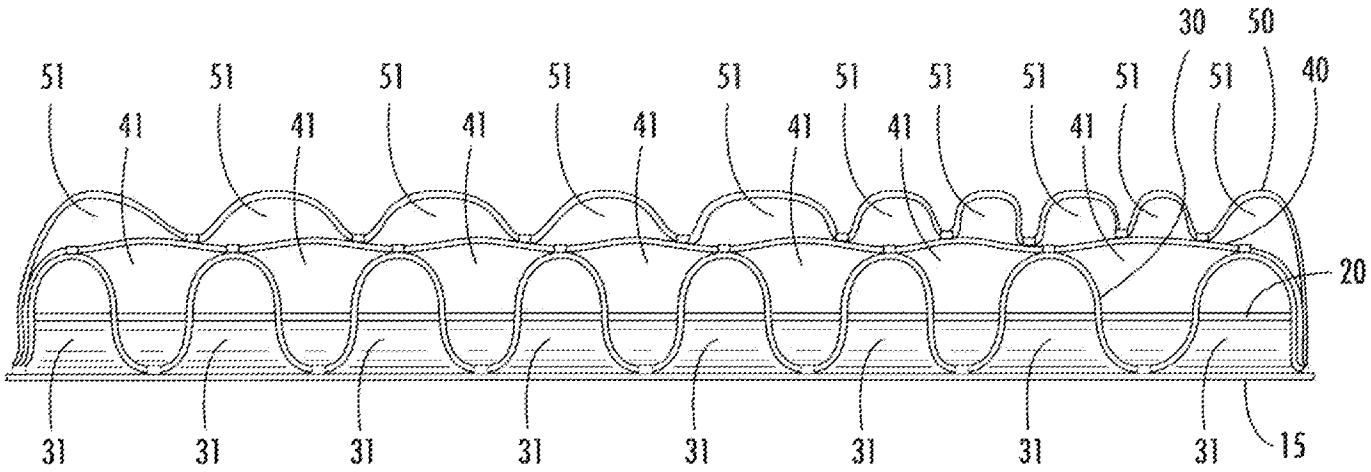
FIG. 3 is a top view of a tool holder described herein.

As shown in FIGS. 1 and 3, the plurality of sleeves 16 can include a first sleeve component 30 forming a plurality of peaks 34 and valleys 36. The peaks 34 and valleys 36 can be formed relative to the main panel 15. For example, valleys 36 can include portions of the first sleeve component 30 that are most proximate to the main panel 15 and peaks 34 can include portions of the first sleeve component 30 that are least proximate to the main panel 15. As shown in FIGS. 1 and 3, the plurality of sleeves 16 can also include a third sleeve component 50 forming a plurality of outer peaks 54 and outer valleys 56. The outer peaks 54 and outer valleys 56 of the third sleeve component 50 can be formed relative to the second sleeve component 40 and/or the main panel 15, e.g., the outer valleys 56 can include portions of the third sleeve component 50 that are most proximate to the second sleeve component 40 or main panel 15 and the outer peaks can include portions that are least proximate to the second sleeve component 40 or main panel 15. The terms peaks and valleys are intended to include minor deviations from the locations described herein. As used herein, "proximate" is intended to include deviations of plus or minus 1 millimeter (mm), or plus or minus 5 mm, or plus or minus 10 mm, or plus or minus 15 mm.

Figure 8:
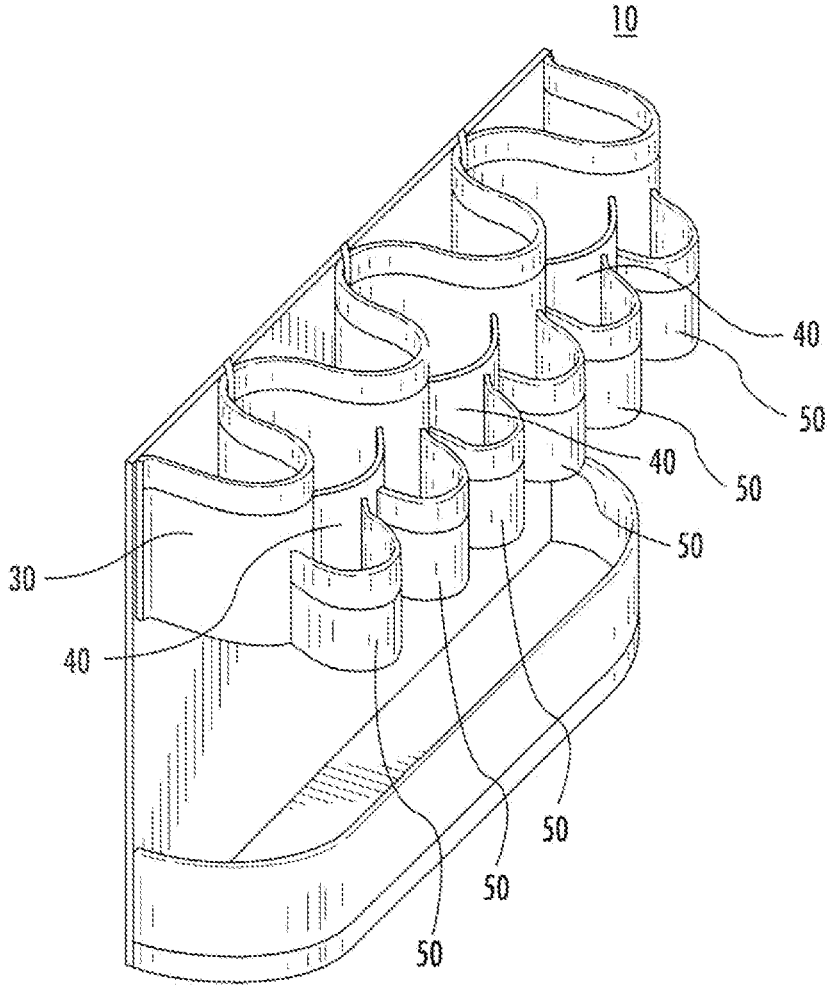
FIG. 8 is a perspective view of a tool holder described herein

Each of the sleeve components 30, 40, 50 can be continuous or discrete. For example, as shown in FIG. 1, the first sleeve component 30 can include a continuous sinusoidal strip of material forming a series of peaks 34 and valleys 36 between the ends. In other arrangements, the first sleeve component 30 can include a continuous triangular strip. The second sleeve component 40 can include a continuous strip of material, extending over a lower portion of the first sleeve component 30. In another arrangement, as shown in FIG. 8, the second sleeve component 40 can include multiple discrete strips of material. The third sleeve component 50 can include a continuous strip of material, including a continuous sinusoidal strip of material, extending over a lower portion of the second sleeve component 40. In another arrangement, as shown in FIG. 8, the third sleeve component 50 can include multiple discrete strips of material.

Figure 5:
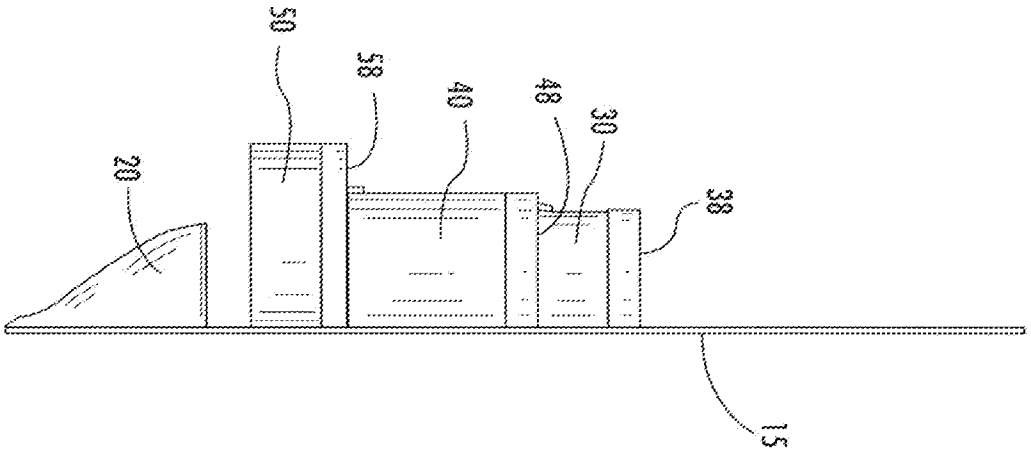
FIG. 5 is a side view of a tool holder described herein.
Figure 6:
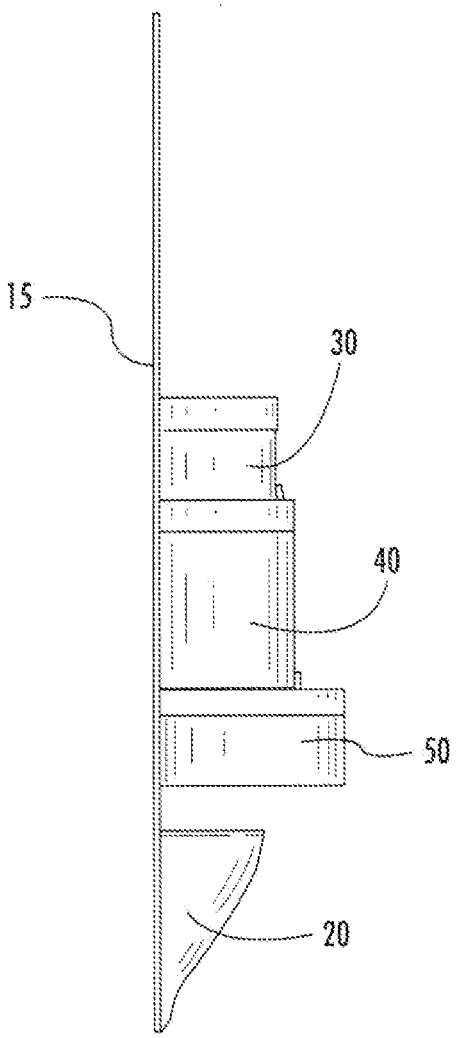
FIG. 6 is another side view of a tool holder described herein.

Each of the sleeve components 30, 40, 50 can also include an upper edge 38, 48, 58. The upper edge 38 of the first sleeve component 30 can extend above the upper edge 48 of the second sleeve component 40, as shown in FIG. 5. In other embodiments, the upper edge 38 of the first sleeve component 30 can be flush with the upper edge 48 of the second sleeve component 40, or the upper edge 38 of the first sleeve component 30 can be disposed below the upper edge 48 of the second sleeve component 40. In arrangements where the upper edge 38 is flush with or disposed below the upper edge 48, the first sleeve component 30 in the Figures would be cut off at the level of or below the upper edge 48 of the second sleeve component 40.

The upper edge 58 of the third sleeve component 50 can extend below the upper edge 48 of the second sleeve component 40, as shown in FIG. 5. In another embodiment, the upper edge 58 of the third sleeve component 50 can be flush with the upper edge 48 of the second sleeve component 40, or the upper edge 58 of the third sleeve component 50 can be disposed above the upper edge 48 of the second sleeve component 40. In arrangements where the upper edge 58 is flush with or disposed above the upper edge 48, the second sleeve component 40 in the Figures would be cut off at the level of or below the upper edge 58 of the third sleeve component 50.

Each of the plurality of sleeves 30, 40, 50 can be coupled to another of the sleeves 30, 40, 50 and/or the main panel 15 at coupling points 37, 47, 57. The coupling points 37, 47, 57 can be at any suitable locations. As used herein, "coupling point" refers to any point, line, area, or region along which the components 30, 40, 50 are coupled. Exemplary methods of coupling can include, but are not limited to, stitching, adhesives, snaps, rivets, bindings, other appropriate fasteners, hook and loop fasteners, welding, soldering, casting, molding, and combinations thereof. In some embodiments, any or all of the first, second and third sleeve components 30, 40, 50 can be coupled as a unitary molded plastic material.

Figure 7:
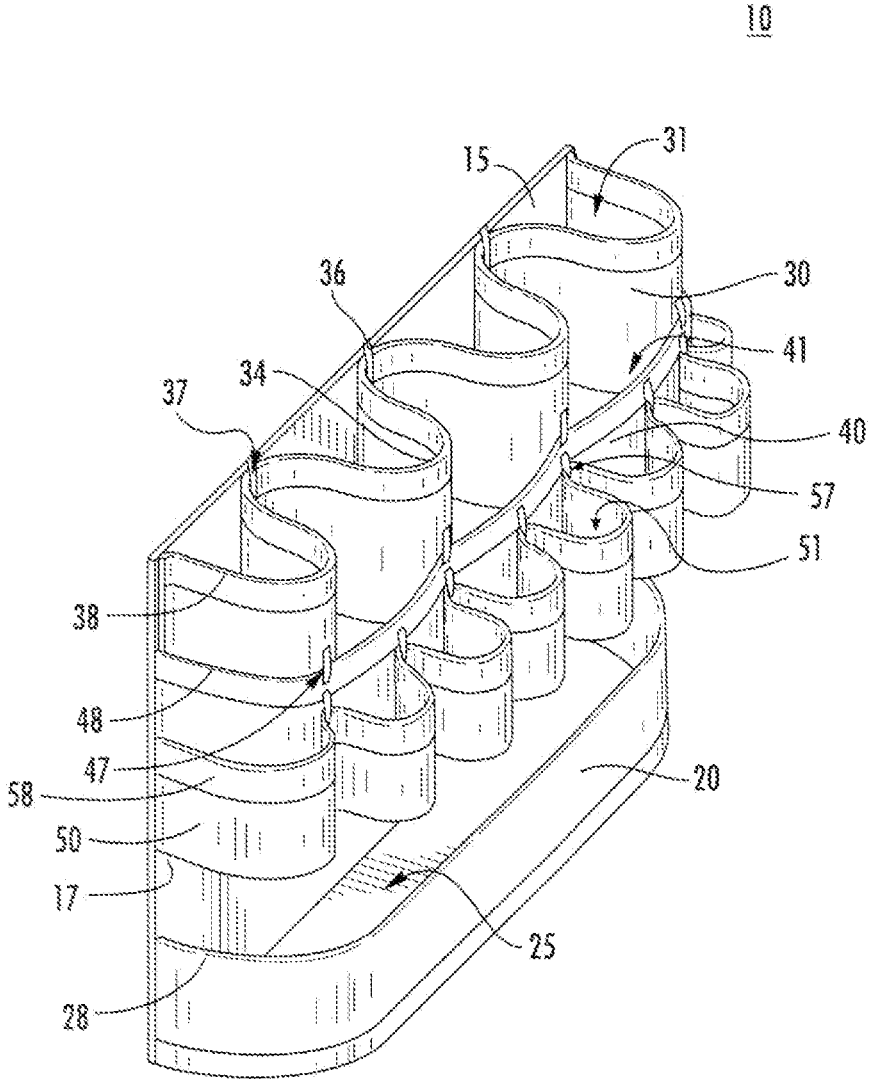
FIG. 7 is a perspective view of a tool holder described herein.

The second sleeve component 40 can be coupled to the first sleeve component 30 at a plurality of inner coupling points 47. As shown in FIGS. 1 and 7, the inner coupling points 47 can be positioned at the peaks 34 of the first sleeve component 30. The inner coupling points 47 can also be positioned between adjacent peaks 34 of the first sleeve component 30.

As shown in FIG. 8, the inner coupling points 47 can include at least two points between adjacent peaks 34 of the first sleeve component 30 to form a secondary opening 41 between each set of adjacent peaks 34. In other examples, a tool holder 10 can include more than two inner coupling points 47 between adjacent peaks 34 of the first sleeve component 30 to form more than one secondary opening 41 between each set of adjacent peaks 34.

Figure 2:
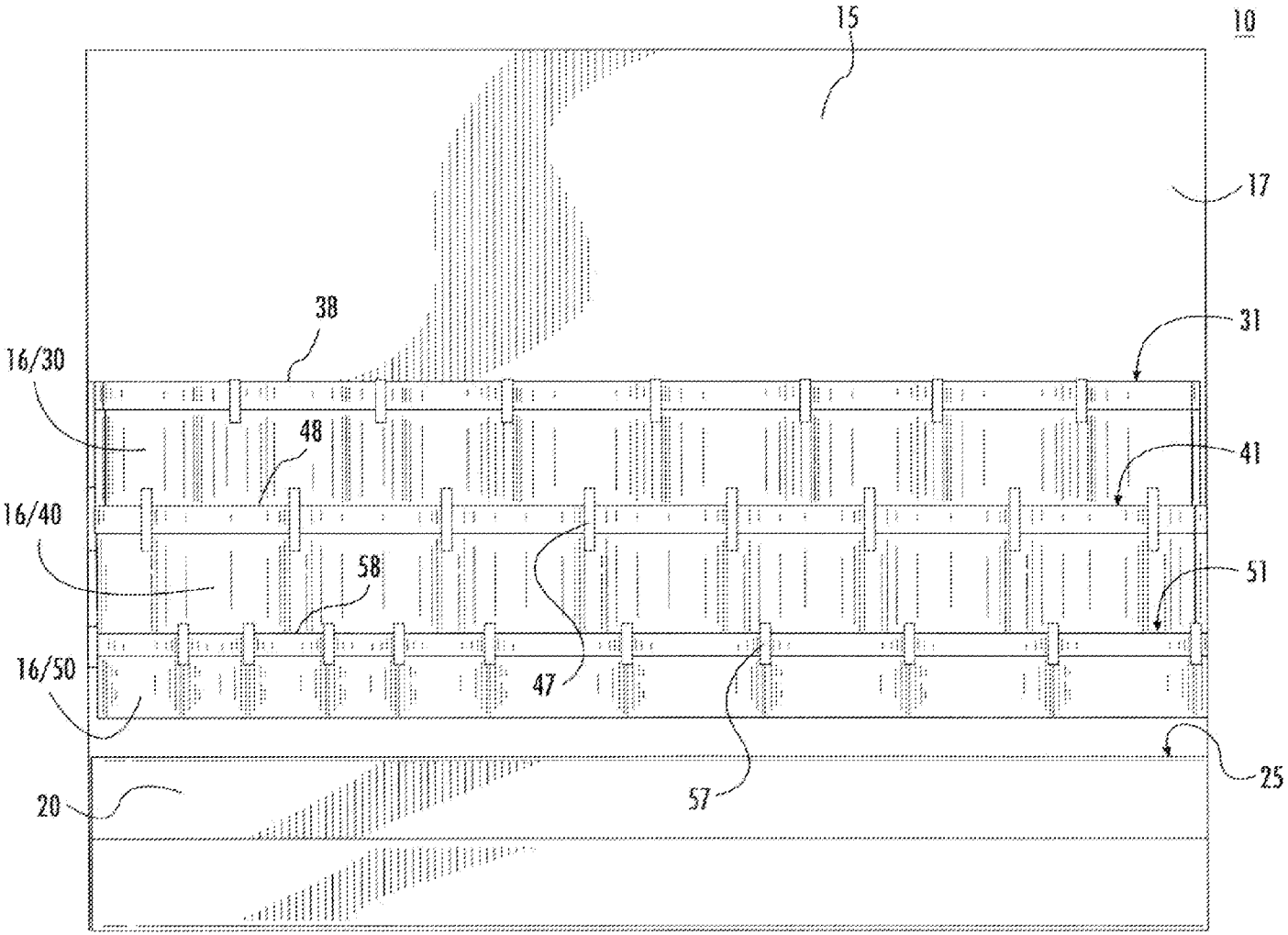
FIG. 2 is a front view of a tool holder described herein.

The third sleeve component 50 can be coupled to the second sleeve component 40 at a plurality of outer coupling points 57. As shown in FIG. 2, the outer coupling points 57 can also be lines or strips. As shown in FIGS. 1 and 7, the outer coupling points 57 can be positioned at or near the outer valleys 54 of the third sleeve component 50.

One or more of the outer coupling points 57 can be vertically aligned (including collinear or parallel) with one or more inner coupling points 57 as shown in FIG. 7. One or more of the outer coupling points 57 can also be offset from the inner coupling points 47. For example as shown in FIG. 7, the positions of the outer coupling points 57 can alternate with every other point 57 vertically aligned with an inner coupling point 47 and the remaining portion of outer coupling points 57 offset from the inner coupling points 47. In other arrangements, the alignment of all of the outer coupling points can be offset from the inner coupling points 47 as shown in FIG. 8.

Figure 4:
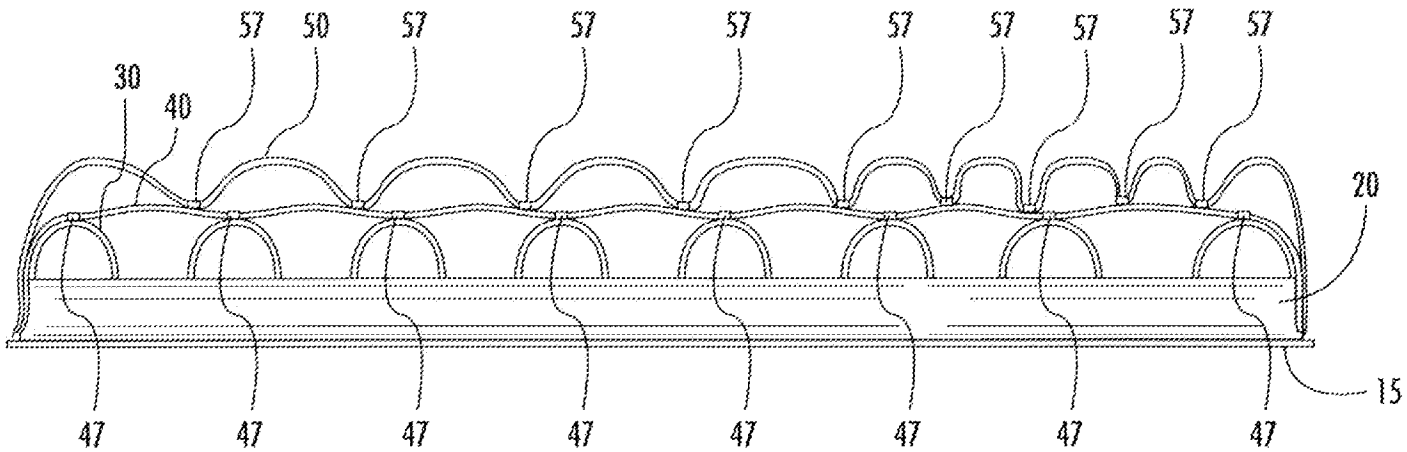
FIG. 4 is a bottom view of a tool holder described herein.

As shown in FIGS. 3 and 4, the tool holder 10 can include at least one inner coupling point 47 at or proximate adjacent peaks 34 of the first sleeve component 30. At least one secondary opening 41 can be formed between the second sleeve component 40, the first sleeve component 30 and sets of adjacent peaks 34. In other examples, the tool holder 10 can include two or more inner coupling points 47 between adjacent peaks 34 of the first sleeve component 30. One or more secondary openings 41 can be formed between the first and second sleeve components 30, 40 and sets of adjacent peaks 34 as shown in FIG. 8.

The tool holder 10 can also include one or more outer coupling points 57 between adjacent inner coupling points 47. One or more tertiary openings 51 can be formed between the third sleeve component 50 and the second sleeve component 40 between sets of adjacent inner coupling points 47.

One or more of the plurality of sleeves 30, 40, 50 can also be coupled to the main panel 15. For example, the first sleeve component 30 can also be coupled to the main panel 15 at a plurality of base coupling points 37 in any suitable location by any of the coupling techniques described herein. In one arrangement, the valleys 36 of the first sleeve component 30 can be coupled to the front side 17 of the main panel 15 by stitching as shown in FIGS. 1 and 7, in other examples, the first sleeve component 30 can be coupled to the main panel 15 as a unitary molded plastic material or via adhesive.

In other examples, the first sleeve component 30 can be secured in position by compression and friction. For example, the ends and/or peaks of the first sleeve component 30 can be restrained by compression and friction between the main panel 16 and second sleeve component 40. In such an arrangement, the first sleeve component 30 an, optionally, be removable.

As shown in FIGS. 1 and 3, at least one primary opening 31 can be formed between the main panel 15 and the first sleeve component 30 between adjacent valleys 36 of the first sleeve component 30. At least one secondary opening 41 can be formed between the second sleeve component 40 and the first sleeve component 30 between adjacent peaks 34 of the first sleeve component 30. At least one tertiary opening 51 can be formed between the third sleeve component 50 and the second sleeve component 40 between adjacent outer valleys 56 and/or coupling points 57 of the third sleeve component 50.

A longitudinal axis of the at least one tertiary opening 51 can be parallel with a longitudinal axis of the at least one primary opening 31 as shown in FIG. 7 or a longitudinal axis of the at least one secondary opening 41. In other arrangements, the longitudinal axis of the tertiary opening 51 can be offset laterally from either or both longitudinal axes of the primary and secondary openings 31, 41. As used herein with respect to the openings, the parallel or offset alignment of the openings 31, 41, 51 refers to the relative position along a lateral axis of a longitudinal axis through the center or midpoint of each opening. For example as shown in FIG. 3, the alignment of the primary openings 31 and the secondary openings 41 are offset.

Each of the openings 31, 41, 51 can be configured for a toil, such as a screwdriver, to be received through the opening 31, 41, 51 and retained in a substantially upright (e.g., vertical) position in the tool holder 10. As shown in FIGS. 1 and 3, the at least one primary opening 31, at least one secondary opening 41 and at east one tertiary opening 51 can include multiple openings. The number of openings 31, 41, 51 can vary based on the dimensions of the main panel 15 and/or the type and shape of tools to be accommodated.

The tool holder 10 can also include a pocket 20 extending from a lower end 19 of the main panel 13. The pocket 20 can define an inner cavity 25 for receiving a tool, e.g. a distal end of a tool. The pocket 20 and the plurality of sleeves 16 can be separated vertically by a distance adapted for receiving and storing a tool supported in the primary, secondary or tertiary openings 31, 41, 51. In one arrangement, the pocket 20 can be disposed below the plurality of sleeves 16 such that an end of a tool, such as a screwdriver, received through any of the above openings 31, 41, 51 can be received in the inner cavity 25 of the pocket 20.

As used herein, "vertical" and "vertically" are used to refer to the vertical direction when the tool holder 10 is in an upright position, for example as shown in FIGS. 1 and 2. The terms vertical and vertically are intended to include minor deviations from the direction defined herein. For example, deviations of plus or minus 15 degrees, or plus or minus 10 degrees, or plus or minus 5 degrees.

The plurality of sleeves 16 and/or the pocket 20 can include any materials suitable for the tool holders described herein, such as fabric, e.g. nylon or canvas. plastic, leather, or combinations thereof, e.g. plastic reinforced fabric. Exemplary plastic reinforced fabric materials include those sold under the SPUNTUFF® trademark.

Figure 9:
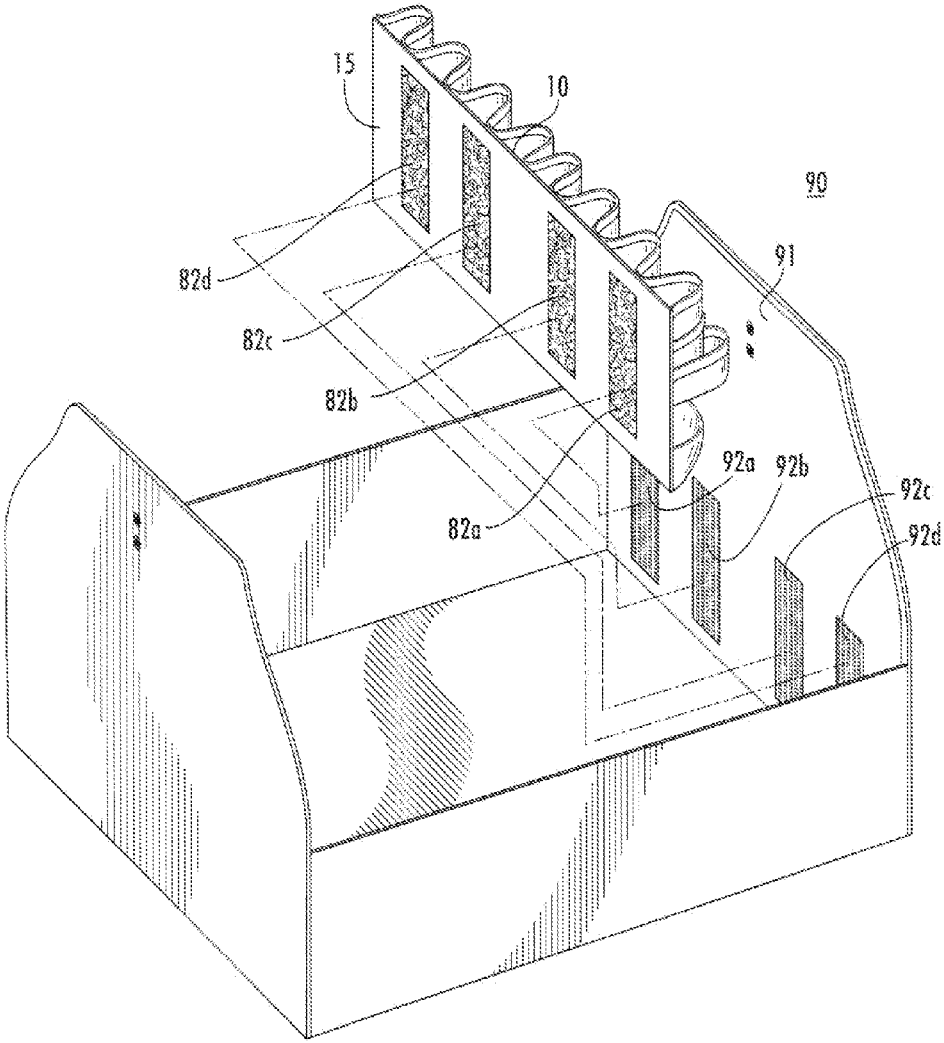
FIG. 9 is an exploded view of a tool bag described herein.

The tool holder 10 can also be configured to be removably or fixedly attached to a tool bag. For example, a tool holder 10 as described above can also include attachment elements such that the tool holder 10 can be removably attached to a side panel or lid panel of a tool bag. Removable attachment can be by any suitable means and exemplary attachment elements can include adhesives, fasteners such as snaps, buttons, zippers, hook and loop fasteners, tracks, tongue-and-groove, friction from adjacent side panels, and combinations thereof. For example as shown in FIG. 9, removable attachment elements 82*a*, 82*b*, 82*c*, 82*d* can be disposed on the tool holder 10, including on a back side of the main panel 15 of the tool holder 10. Corresponding removable attachment elements 92*a*, 92*b*, 94*c*, 92*d* can be disposed on a side panel 91 of a tool bag 90. The removable attachment elements 82*a-d* can comprise loops and the removable attachment elements 92*a-d* can comprise hooks, or vice versa.

Figure 10:
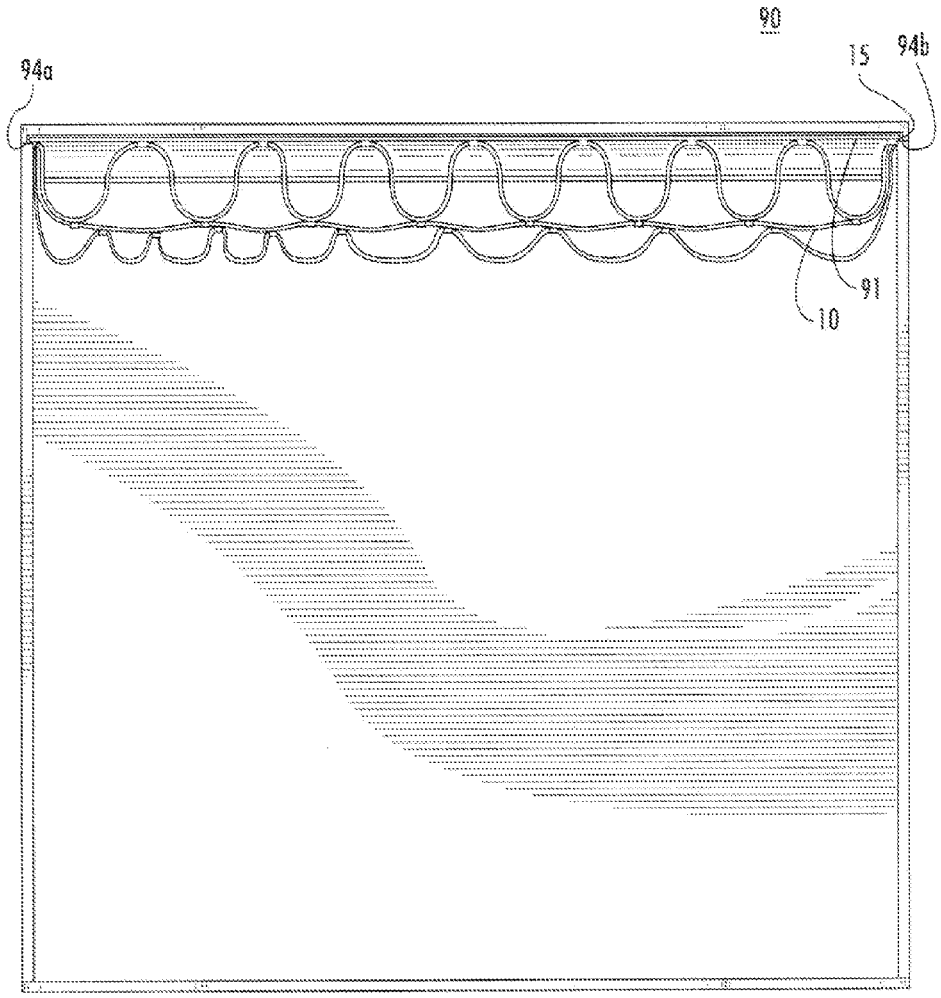
FIG. 10 is a top view of a tool bag described herein.

Removable attachment elements can also be disposed on either of the tool holder 10 or the tool bag 90. As shown in FIG. 10, removable attachment elements 94*a*, 94*b* can be included on the tool bag 90. The removable attachment elements 94*a*, 94*b* can comprise tracks on one or more of the sidewalls 91 of the tool bag 90, and the main panel 15 of the tool holder 10 can slidably engage with the tracks 94*a*, 94*b*. Tracks 94*a*, 94*b* can be integral in one or more sidewalls 91 as shown in FIG. 10, or can extend from a sidewall 91 including an end wall.

Figure 11:
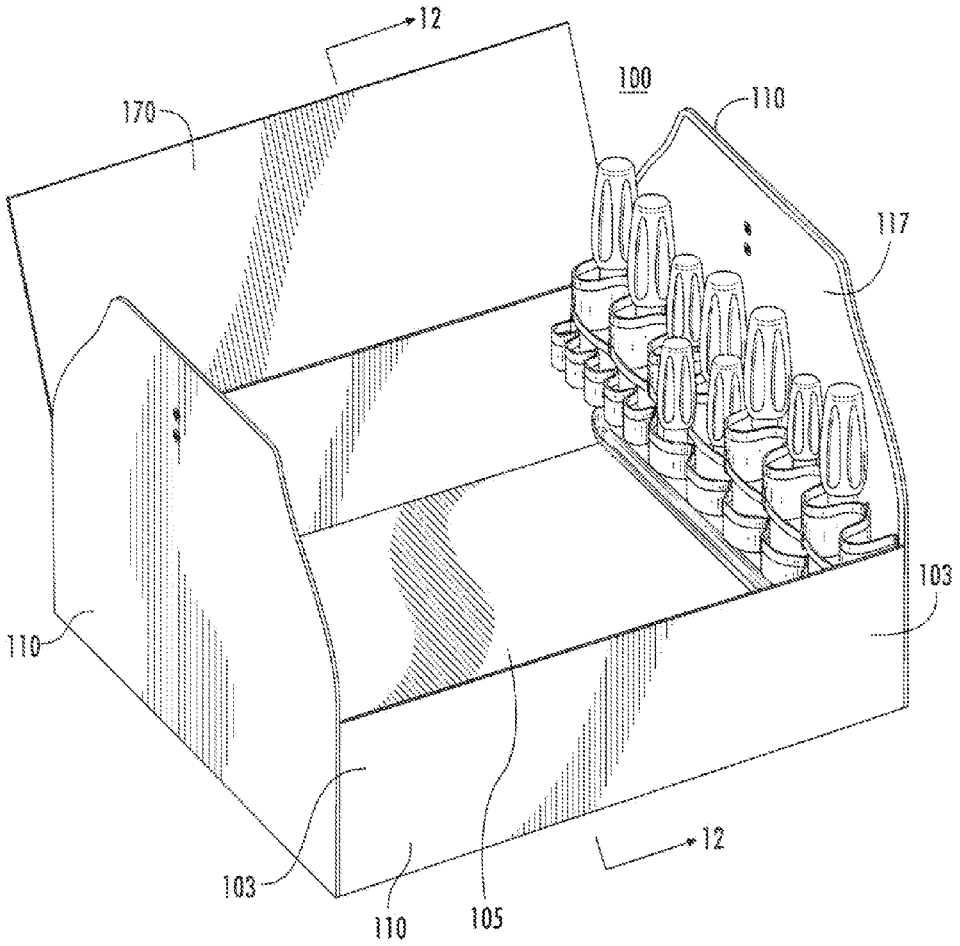
FIG. 11 a perspective view of a tool bag described herein.
Figure 12:
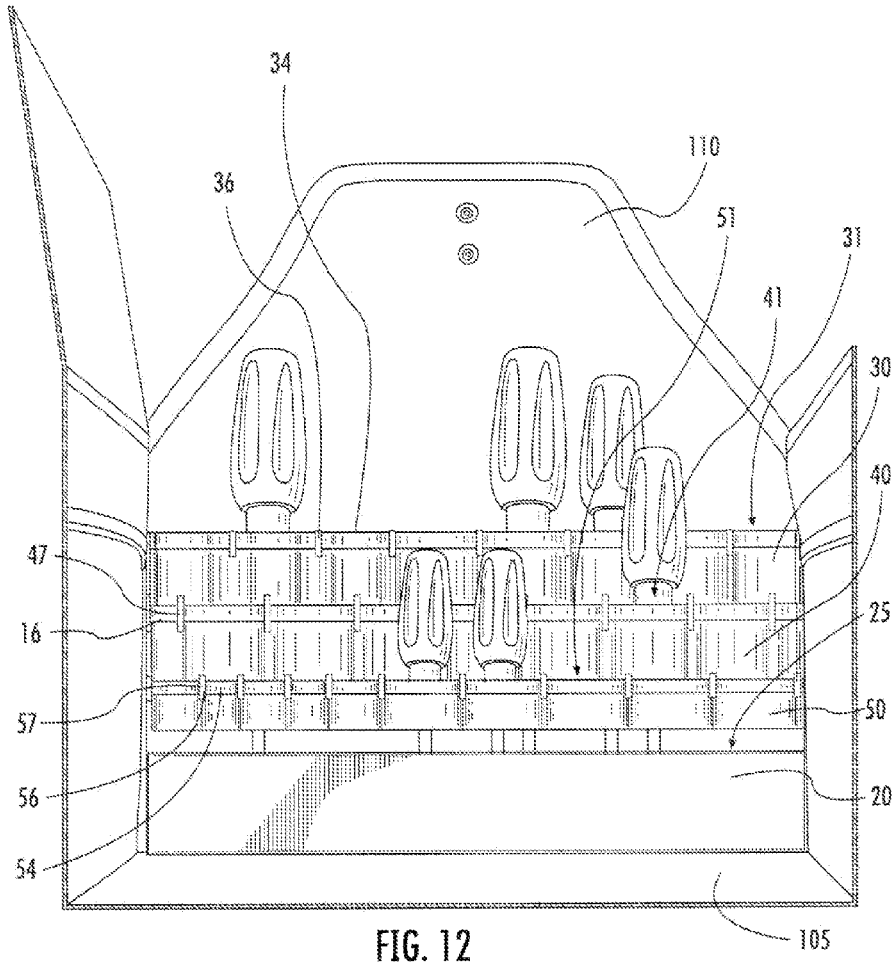
FIG. 12 is a cross sectional view of a sidewall of a tool bag described herein, taken along cut line 12-12 in FIG. 11.

In another arrangement, the tool holder can be integrated with a tool bag body. As shown in FIGS. 11 and 12, a tool bag 100 having a tool holder 10 attached to a tool bag body 103 also described herein. The tool bag body 103 can include an open topped storage volume formed from a bottom panel 105 and a plurality of side panels 110. Each of the plurality of side panels 110 of the tool bag body can include a front side 117.

At least one of the plurality of side panels 110 further comprises a plurality of sleeves 16 extending from the front side of the side panel 110. The plurality of sleeves 6 can be farmed from first, second and third sleeve components 30, 40, 50. The sleeve components 30, 40, 50 can form openings 31, 41, 51, such that a tool can be received through each opening 31, 41, 51.

The first, second and third sleeve components 30, 40, 50 can be continuous or discrete. The first sleeve component 30 can form a plurality of peaks 34 and valleys 36 and the second sleeve component 40 can be coupled to the first sleeve component 30 at a plurality of inner coupling points 47. The third sleeve component 50 can form a plurality of outer peaks 54 and outer valleys 56 and the third sleeve component 50 can be coupled to the second sleeve component 40 at a plurality of outer coupling points 57.

At least one primary opening 31 can be formed between the side panel 110 and the first sleeve component 30 between adjacent valleys 36 of the first sleeve component 30. At least one secondary opening 41 can be formed between the second sleeve component 40 and the first sleeve component 30 between adjacent peaks 34 of the first sleeve component 30. At least one tertiary opening 51 can be formed between the second sleeve component 40 and the third sleeve component 50 between adjacent outer valleys 56 of the third sleeve component 50.

The bottom panel 105 and the plurality of sleeves 30, 40, 50 can be separated vertically by a distance adapted for receiving and storing a tool supported in the primary, secondary or tertiary openings 31, 41, 51. In other arrangements, the tool bag 100 can also include a pocket 20 extending from a lower end of the front side 117 of the side panel 110, and the pocket 20 and the plurality of sleeves 30, 40, 50 can be separated vertically by a distance adapted for receiving and storing a tool supported in the primary, secondary or tertiary openings 31, 41, 51. The pocket 20 can be disposed above and/or in contact with the bottom panel 105. At least a portion of the pocket 20 can also be formed by at least a portion of the bottom wall 105.

The tool holder can be integrated with the side panel 110 in any suitable position. As shown in FIG. 12, the front side 117 of the plurality of side panels 110 can include an inner side of the plurality of side panels 110. In other arrangements, the front side 117 of the plurality of side panels 110 can include an outer side of the plurality of side panels 110. As used herein, the terms "inner" and "outer" with respect to sides of the side panels refer to a side's proximity to the open topped storage volume. For example, the inner side can be the side of a side panel most proximate to the open topped storage volume and the outer side can be the side least proximate.

The tool bag 100 can also include a lid panel 170 attached to the tool bag body. The lid panel 170 can be attached by any method allowing the lid panel 170 to be opened or moved for access into the tool bag body 103. For example, the lid panel 170 can be removably attached, such as resting on at least a portion of the upper edges of the side panels, or fixedly attached, such as by pivotal attachment to a side panel.

A plurality of screwdrivers can be stored in the tool holder as demonstrated in FIGS. 11 and 12, with the screwdrivers generally positioned upright and side by side. In this configuration, a set of screwdrivers can be easily and efficiently organized, stored and accessed by a user.

The foregoing is provided in the context of one possible application for a tool holder according to aspects of the invention. While the above description and figures are made in the context of a set of screwdrivers, it will be understood that the apparatus according to aspects of the invention can be readily applied to other tools as well including a mixture of types of tools. Thus, it will of course be understood that the invention is not limited to the specific details described herein, which are given by way of example only, and that various modifications and alterations will be apparent to those skilled in the art and may be made without departing from the scope or spirit of this invention.

What is claimed is:

1. A tool holder, comprising:

a main panel having a front side; and a plurality of sleeves extending from the front side, each of said sleeves having an upper opening and a lower opening, whereby a tool can be received through each opening, said plurality of sleeves comprising:

a first sleeve component forming a plurality of peaks and valleys;

a second sleeve component coupled to said first sleeve component at a plurality of inner coupling points;

a plurality of primary sleeves formed between said main panel and said first sleeve component between adjacent valleys;

a plurality of secondary sleeves formed between said second sleeve component and said first sleeve component between adjacent peaks; wherein tools retained by any of said plurality of sleeves can pass through an upper opening-lower opening pair of a sleeve and be exposed below said sleeve; and a pocket extending from a lower end of the front side, said pocket having an inner cavity for receiving and stabilizing tools supported by any of the plurality of sleeves, wherein said pocket and said plurality of primary sleeves and the plurality of secondary sleeves are separated vertically by a distance and said pocket is adapted for supporting tools retained by said plurality of sleeves.

2. The tool holder according to claim 1, wherein said valleys of the first sleeve component are coupled to said front side of the main panel at a plurality of base coupling points.

3. The tool holder according to claim 1, wherein said inner coupling points are positioned at or between adjacent peaks of said first sleeve component.

4. The tool holder according to claim 1, wherein said inner coupling points comprise at least two points between adjacent peaks of said first sleeve component.

5. The tool holder according to claim 1, wherein said outer coupling points are vertically aligned with or positioned between adjacent inner coupling points.

6. The tool holder according to claim 1, wherein at least two adjacent outer coupling points are positioned between at least two adjacent inner coupling points.

7. The tool holder according to claim 1, further comprising:

a third sleeve component forming a plurality of outer peaks and outer valleys, and coupled to said second sleeve component at a plurality of outer coupling points; and a plurality of tertiary sleeves formed between said second sleeve component and said third sleeve component between adjacent outer valleys.

8. The tool holder according to claim 7, wherein longitudinal axes of said plurality of tertiary sleeves are in substantial alignment with corresponding longitudinal axes of said plurality of primary sleeves.

9. The tool holder according to claim 7, wherein a longitudinal axes of said plurality of tertiary sleeves are in substantial alignment with corresponding longitudinal axes of said plurality of said secondary sleeves.

10. The tool holder according to claim 7, wherein an upper edge of said third sleeve component is below an upper edge of said second sleeve component.

11. The tool holder according to claim 1, wherein said plurality of sleeves comprise materials selected from the group consisting of fabric, non-wovens, plastic, plastic-reinforced fabric, and combinations thereof.

12. The tool holder according to claim 1, wherein said inner cavity extends continuously below said plurality of sleeves.

13. A tool bag, comprising:

a tool bag body comprising an open topped storage volume formed from a bottom panel and a plurality of side panels;

wherein each of the plurality of side panels comprises a front side; and at least one of the plurality of side panels further comprises a plurality of sleeves extending from the front side and forming openings, whereby a tool can be received through each opening, said plurality of sleeves comprising:

a first sleeve component forming a plurality of peaks and valleys;

a second sleeve component coupled to said first sleeve component at a plurality of inner coupling points;

a plurality of primary sleeves formed between said main panel and said first sleeve component between adjacent valleys;

a plurality of secondary sleeves formed between said second sleeve component and said first sleeve component between adjacent peaks; and a pocket extending from a lower end of the front side of said front side, said pocket having an inner cavity for receiving and stabilizing tools supported by the plurality of sleeves, wherein said pocket and said plurality of sleeves are separated vertically by a distance and said pocket is adapted for supporting tools retained by said plurality of sleeves.

14. The tool holder according to claim 13, wherein said inner cavity extends continuously below said plurality of sleeves.

* * * * *